US008118978B2

(12) United States Patent
Aaltonen et al.

(10) Patent No.: US 8,118,978 B2
(45) **Date of Patent: *Feb. 21, 2012**

(54) RUNNABILITY COMPONENT AND A METHOD FOR SAVING ENERGY IN A DRYING SECTION OF A PAPER MACHINE OR THE LIKE

(75) Inventors: Rami Aaltonen, Turku (FI); Nenad Milosavljevic, Turku (FI)

(73) Assignee: Metso Paper, Inc., Helsinki (FI)

( * ) Notice: Subject to any disclaimer, the term of this patent is extended or adjusted under 35 U.S.C. 154(b) by 28 days.

This patent is subject to a terminal disclaimer.

(21) Appl. No.: 12/810,464

(22) PCT Filed: Dec. 31, 2008

(86) PCT No.: PCT/FI2008/000148

§ 371 (c)(1),
(2), (4) Date: Jun. 24, 2010

(87) PCT Pub. No.: WO2009/083636

PCT Pub. Date: Jul. 9, 2009

(65) Prior Publication Data

US 2010/0276096 A1 Nov. 4, 2010

(30) Foreign Application Priority Data

Dec. 31, 2007 (FI) ..... 20071031
Dec. 31, 2007 (FI) ..... 20071033

(51) Int. Cl.
*D21F 11/00* (2006.01)

(52) U.S. Cl. ..... 162/202; 162/205; 162/289; 162/358.1; 34/114; 34/115; 34/116; 34/123

(58) Field of Classification Search ..... 162/202, 162/205, 289, 358.1; 34/114, 115, 116, 123
See application file for complete search history.

(56) References Cited

U.S. PATENT DOCUMENTS

| | | | |
|---|---|---|---|
| 6,574,884 | B1 | 6/2003 | Jokinen |
| 7,422,662 | B2 | 9/2008 | Leimu et al. |
| 2005/0075229 | A1 | 4/2005 | Kurki et al. |

FOREIGN PATENT DOCUMENTS

| | | |
|---|---|---|
| EP | 1 717 367 | 11/2006 |
| FI | 110625 | 8/2000 |
| FI | 110442 | 1/2003 |
| FI | 115232 | 6/2004 |

OTHER PUBLICATIONS

Search Report (dated Nov. 17, 2008) from Finland Patent Office in priority Application No. FI 20071033.

*Primary Examiner* — Mark Halpern
(74) *Attorney, Agent, or Firm* — Cozen O'Connor

(57) ABSTRACT

The invention relates to an arrangement and a method of a paper machine or the like for saving energy in the drying section. According to the invention, in the drying section of a paper machine or the like in connection with a pocket space (9) between two drying cylinders (1, 2) and one turn roll (3), there are the following delimiting said pocket space (9): a first drying cylinder (1), a second drying cylinder (2), a turning suction roll (3) and a wire (5, 5*a*, 5*b*), which is arranged to travel from the first drying cylinder (1) to the turning suction roll (3) and from there on to the second drying cylinder (2). The arrangement further comprises a box-like runnability component (10) and a sealing element (19) arranged in the lower part of the runnability component (10), in the gap between the runnability component and the turning suction roll (3) in order to seal said gap and thereby to promote the operation of the turning suction roll (3).

19 Claims, 6 Drawing Sheets

RUNNABILITY COMPONENT AND A METHOD FOR SAVING ENERGY IN A DRYING SECTION OF A PAPER MACHINE OR THE LIKE

PRIORITY CLAIM

This is a national stage of PCT application No. PCT/FI2008/000148, filed on Dec. 31, 2008. Priority is claimed on patent application No. 20071031 filed in Finland on Dec. 31, 2007, and on patent application No. 20071033 filed in Finland on Dec. 31, 2007.

TECHNICAL FIELD RELATING TO THE INVENTION

The object of the invention is an arrangement and a method for saving energy in a drying section of a paper machine or the like according to the preambles of the independent claims presented below.

PRIOR ART

In a typical drying section of a paper machine or a board machine the web to be dried is conveyed supported by one or two wires in contact with hot drying cylinders. A disadvantage has been the tendency of the web to detach, at certain points, from the contact with the drying wire thereby causing runnability problems. Problematic points are especially

- so-called opening nips, i.e. points where the web and the wire disengage from the drying cylinder. Up to that point, the web has traveled between the wire and the cylinder, and when the wire detaches from the cylinder, the web tends to follow the cylinder surface and thereby to disengage from the wire; and
- so-called closing nips, where the web and the wire are brought into contact with the cylinder. At that point, the web tends to disengage from the wire due to an overpressure formed in the nip.

Opening and closing nips exist both at the drying cylinders and in connection with the turn rolls located between the drying cylinders.

It is previously known to use different kinds of runnability components, such as blow or suction boxes and turning suction rolls in order to create underpressure in the pocket space between the drying cylinders. The underpressure promotes keeping of the web in contact with the wire and thereby improves the runnability of a paper machine. However, creating underpressure by means of runnability components usually consumes a considerable amount of energy.

Patent FI 110442 discloses an impingement unit of a paper machine aiming at a controlled curling of the paper and a good runnability, but the publication does not disclose solutions for saving energy.

OBJECT AND DESCRIPTION OF THE INVENTION

The object of this invention is to reduce or even completely eliminate problems related to prior art.

An object of this invention is to reduce energy consumption in the drying section of a paper machine or the like, especially when creating underpressure in a pocket space between two drying cylinders and one turn roll, preferably a turning suction roll.

Another object of this invention is to enable the use of a lower underpressure in order to create an underpressure in the pocket space without impeding the runnability of the paper machine or the like.

A further object of this invention is to promote keeping of the web in contact with the wire in connection with the opening nip of the first drying cylinder and in connection with the closing nip of the second drying cylinder.

In order to realise, among other things, the above-mentioned objects, the arrangement and the method according to the invention are characterized by what is presented in the characterizing parts of the enclosed independent claims.

The embodiments mentioned in this text relate, where applicable, to both the arrangement and the method according to the invention, even if this is not always separately mentioned.

A typical arrangement according to the invention for saving energy in the drying section of a paper machine or the like in connection with a pocket space between two drying cylinders and one turning suction roll comprises the following delimiting said pocket space

- a first drying cylinder,
- a second drying cylinder located after the first drying cylinder as seen in the longitudinal direction of the machine,
- a turn roll arranged to be located in a horizontal direction between said drying cylinders in the longitudinal direction of the machine, however lower in the vertical direction than said cylinders, and
- a wire, which is arranged to travel from the first drying cylinder to the turn roll, and from there further on to the second drying cylinder, and which, together with the web supported by it, defines a web path in which the web can be guided in between the wire and the drying cylinders as well as to the outer surface of the wire on the periphery of the turn roll.

In addition, the arrangement comprises a box-like runnability component, which is elongated in the cross direction of the paper machine or the like and extends substantially over the entire width of the web run and is at least mainly arranged in said pocket space, and which runnability component is provided with an entry side, a lower part and an exit side, and on the entry side the runnability component has an entry side blow nozzle in connection with a gap between the runnability component and the first drying cylinder in order to blow air substantially against the travelling direction of the web run, away from the pocket space. A first sealing element is arranged in the lower part of the runnability component, in a gap between the runnability component and the turn roll, in order to seal said gap and thereby to intensify the operation of the turn roll.

Thus, the second drying cylinder is arranged, in the machine direction, after the first drying cylinder so that the longitudinal axes of the first and the second drying cylinders are substantially parallel and are located in the same horizontal level. A typical drying section comprises a number of such parallel drying cylinders located at a same level. The turn roll is arranged between two adjacent drying cylinders so that the longitudinal axis of the roll is substantially parallel with the longitudinal axes of the drying cylinders, but the roll is located at a lower level in the vertical direction than the drying cylinders. The turn roll is placed between the drying cylinders so that its surface does not touch the surfaces of the drying cylinders.

In a typical method according to the invention for saving energy in the drying section of a paper machine or the like in connection with a pocket space between two drying cylinders and one turning suction roll the wire is moved supported by the first drying cylinder, the turn roll and the second drying cylinder, which drying cylinders, turn roll and wire delimit the pocket space, and the wire together with the web supported by it forms a web path, in which the web can be guided in between the wire and the drying cylinders and to the outer surface of the wire on the periphery of the turn roll, the space between the pocket space and the space outside it is sealed by means of a box-like runnability component, which is elongated in the cross direction of the paper machine or the like and extends substantially over the entire width of the web run and is at least mainly arranged in said pocket space, and which runnability component is provided with an entry side, a lower part and an exit side, and on the entry side the runnability component has an entry side blow nozzle in connection with a gap between the runnability component and the first drying cylinder by means of which blow nozzle air is blown substantially against the travelling direction of the web, away from the pocket space.

The operation of the turn roll is intensified by sealing the gap between the runnability component and the turn roll by means of a first sealing element arranged in the lower part of the runnability component.

It has now been surprisingly found out that by arranging the first sealing element in the lower part of the runnability component, towards the turn roll, such that it seals the gap between the runnability component and the turn roll, and by simultaneously arranging a second sealing element to seal the gap between the runnability component and the first drying cylinder, the underpressure prevailing in the pocket space can be considerably intensified by means of these two seals. For example, the operation of the turning suction roll is considerably intensified when a first sealing element is arranged in the lower part of the runnability component, in connection with the gap between the runnability component and the turning suction roll. In practice, the suction from the roll needed for creating an underpressure can be reduced, which naturally reduces the energy consumption of the suction elements. The energy saving thereby achieved can be considerable, even surprisingly high. According to certain calculations, the energy consumption of the drying section can be thereby reduced even by 10%, sometimes even by 15% or even by 20%.

In this application, the exit side and the entry side of the pocket space have the following meaning: The pocket space can be divided, in the horizontal longitudinal direction of the machine, at the midpoint of the pocket space, into an entry side and an exit side by an imaginary vertical level having the width of the web run. On the entry side, i.e. between the first drying cylinder and the turning suction roll, and on the exit side, i.e. between the turning suction roll and the second drying cylinder, the pocket space is delimited by the wire, and therefore, during the run, also by the web path formed by the wire and the web.

In this application, the first underpressure zone is a space, which is delimited by the first drying cylinder, the turn roll and the wire travelling via them, the runnability component, the first sealing element directed towards the turn roll, and the second sealing element directed towards the wire and towards the web run supported by the wire at the first drying cylinder. The underpressure can be created, for example, by an underpressure prevailing inside the turn roll and having an effect on the first underpressure zone via openings arranged on the entire periphery of the roll.

In this application, the second underpressure zone is a space in a part of the pocket space located above the sealing element, which second underpressure zone is delimited, in addition to the sealing element, by the first drying cylinder and the entry side of the runnability component. The underpressure is created mainly by an air blow directed towards the web path, away from the pocket space.

Earlier, the underpressure of the pocket space between the drying cylinders and the turn roll has been controlled, in addition to the blow nozzle on the runnability component's entry side, with the exit side blow nozzle, with which air has been ejected out of the pocket space and the entry of air into the pocket space via the gap between the exit side of the runnability component and the second drying cylinder has been prevented. According to an embodiment of the invention, the first sealing element guides the air flow moving in the direction of rotation of the roll along the surface of the exit side of the turn roll, away from the contact with the surface of the turning suction roll. The first sealing element also serves as a concrete physical obstacle for the entry of air into the space between the runnability component and the turn roll. Thus, as small of an amount of air as possible enters into the first underpressure zone from between the sealing element and the turn roll, i.e. in between the runnability component and the turn roll. Due to what has been described above, a sufficient underpressure can be created in the first underpressure zone by means of a considerably lower underpressure than before. Thus, the energy consumption in the drying section of a paper machine or the like can be considerably reduced. Therefore, due to the invention, the energy consumption can be reduced in the drying section of a paper machine simultaneously maintaining the same production rate, or alternatively, the running speed can be increased simultaneously maintaining the same energy consumption in the drying section.

Due to the first sealing element, after the opening nip of the turn roll air is guided away from the pocket space substantially in the direction of the web run, instead of being guided in between the runnability component and the turn roll. At the same time, the flow guided in the direction of the web run ejects with it air away from the pocket space, which causes an underpressure also in the gap between the runnability component and the second drying cylinder, and therefore keeps the web attached to the wire. Due to this, no exit side blow nozzle is needed in the arrangement according to the invention, and therefore the amount of air needed to obtain the underpressure required by the arrangement, for example by means of a blower, is considerably reduced, even by more than 30%. The ejection effect created by the sealing element is emphasized when the running speed of the drying section is increased, which is profitable in view of the runnability and energy efficiency.

The first sealing element can be realized for example as a sealing strip, with which guiding of air on the exit side can be efficiently directed away from the surface of the turn roll and, respectively, blowing on the exit side commonly used in prior art can be even totally eliminated, whereby considerable saving of energy for example per ton of produced paper can be obtained. According to a preferred embodiment of the invention, the exit side of the runnability component is substantially free of blow nozzles or blow gaps, i.e. on the exit side of the runnability component there are no elements or components creating active blows.

According to a preferred embodiment of the invention the first sealing element is arranged to the exit side part of the lower part of the runnability component, i.e. at a point whose distance from the exit side web run delimiting the pocket space is, in the horizontal direction, 1-50% of the horizontal distance between the entry side and exit side web runs, preferably 1-25%, most preferably 1-20%. The first sealing element can thus be arranged closer to the exit side web run delimiting the pocket space than to the entry side web run. The advantage of this embodiment is that as large a part as possible of the upper surface of the turn roll remains in the first underpressure zone delimited by the first sealing element, i.e. on the entry side of the first sealing element seen in the longitudinal direction of the machine. Thereby, for example the suction of the turning suction roll can be utilized as efficiently as possible for creating the underpressure of the first underpressure zone.

The first sealing element is preferably arranged, in view of the air flow, in a streamlined manner in contact with a plane determined by the exit edge of the runnability component.

In an embodiment of the invention, the first sealing element is arranged in contact with the lower part of the runnability component, i.e. the sealing element is arranged in the lower surface of the runnability component, to the surface which is towards the turn roll. The first sealing element can be provided also elsewhere than on the exit side part of the lower part of the runnability component, even though at that point the position is preferable in view of the effect of the turn roll. In one preferred embodiment of the invention, the first sealing element is arranged in the lower surface of the runnability component, on average in the middle of the lower surface of the runnability component. This means that the distance from the connecting point of the first sealing element and the lower surface of the runnability component to the entry side first edge of the lower surface of the runnability component is on average the same as to the exit side second edge.

According to an embodiment of the invention, the first sealing element is thus a sealing strip. The first sealing element is preferably elongated in the cross direction of the paper machine or the like and extends substantially at least over the entire width of the web run. According to an embodiment of the invention, the first sealing element is divided into parts in the lateral direction of the machine. The sealing element can be assembled of several separate sealing element parts, whose length is shorter than that of a finished sealing element. Thereby, the mounting, transportation and storage of the sealing element is easier, as long bracings can be avoided during transports. Separate, individual sealing element parts can also have properties differing from each other, whereby the properties of the first sealing element can vary in the cross direction of the machine, i.e. in the longitudinal direction of the pocket space. By using sealing element parts made of different materials in order to produce the first sealing element, it is possible to precisely control and guide the pressure conditions of the first underpressure zone also in the cross direction of the machine. The sealing element parts can differ from each other also by their design. The first sealing element can thus be formed of several adjacent separate sealing element parts, which by their ends are attached to each other in order to form the first sealing element, and which can differ from each other by their design and/or materials.

According to another embodiment of the invention, more than one, for example two or three, sometimes even four or five first sealing elements can be provided in the lower part of the runnability component in connection with the gap between the runnability component and the turning suction roll, whereby the sealing elements can be arranged for example successively in the machine direction and/or graded with respect to their sealing effect and/or different in their dimensions or material. Preferably the first sealing element is an at least one-chambered labyrinth sealing, preferably a multi-chambered labyrinth sealing. The labyrinth sealing is typically provided with two, three, four or five chambers.

Thus, according to a preferred embodiment of the invention, the arrangement comprises a first underpressure zone delimited by

- said first sealing element,
- lower part and entry side of the runnability component,
- second sealing element, which is arranged in contact with the entry side of the runnability component, between the runnability component and the first drying cylinder,
- web path between the first drying cylinder and the turn roll, and
- upper surface of the turn roll between the closing nip of the roll and the first sealing element.

During the run, the aim is to maintain in the first underpressure zone an underpressure which is approximately typically between 50-700 Pa, more preferably 100-500 Pa, and most preferably 150-300 Pa lower than the normal atmospheric pressure (approximately 1 bar, i.e. $10^5$ Pa).

According to an embodiment of the invention the above mentioned location of the second sealing element is, more precisely described, substantially in connection with the opening nip of the first drying cylinder. The second sealing element is preferably elongated in the cross direction of the paper machine or the like and extends substantially over the entire width of the web run.

According to an embodiment of the invention the second sealing element is preferably an at least one-chambered labyrinth sealing, preferably a multi-chambered labyrinth sealing, which can comprise two, three, four, five or six chambers. The second sealing element can be formed of strips, which can be made of, for example, Teflon or metal, such as aluminium. The second sealing element can also be multi-stepped, i.e. comprising several sealing elements. If the second sealing element is multi-stepped, i.e. it comprises several sealing elements successively in the direction of rotation of the drying cylinder, then the said successive sealing elements can be stepped in their sealing effect and/or different for example in their dimensions or material. According to another embodiment of the invention, also the second sealing element can be divided into parts in the lateral direction of the machine, whereby the sealing element can be assembled of several separate individual shorter sealing element parts. The individual second sealing element parts can also have properties differing from each other, whereby also the properties of the second sealing element can vary in the cross direction of the machine, i.e. in the longitudinal direction of the pocket space. By using second sealing element parts made of different materials, the pressure conditions of the first underpressure zone can be controlled more accurately than before. The second sealing element parts can differ from each other by their design.

A practical embodiment related to the operation and structure of the second sealing element is disclosed in more detail for example in the Finnish patent FI 115232, which corresponds to the U.S. patent application Ser. No. 10/532,962.

According to an embodiment of the invention the arrangement further comprises

- a second underpressure zone in a part of the pocket space located above the second sealing element, which second underpressure zone is delimited, in addition to the second sealing element, by the first drying cylinder and the entry side of the runnability component, and means for creating underpressure in the second underpressure zone so that in the second underpressure zone a higher underpressure can be created than in the first underpressure zone.

During the run, the aim is to maintain the underpressure in the second underpressure zone typically between 800-5000 Pa, more preferably 1000-3000 Pa and most preferably 1500-2500 Pa lower than the normal atmospheric pressure level ($10^5$ Pa).

According to an embodiment of the invention, as the means for creating an underpressure in the second underpressure zone are mentioned the blow nozzle of the entry side, whose purpose is to eject air away from the second underpressure zone and/or to resist the air entering therein. In this embodiment the ejection of the air takes place against the travelling direction of the web run, away from the pocket space. The Coanda-effect can be used to carry out the blow for creating an air flow and for directing it in a manner known as such. From the blow nozzle, the air flow is directed to a curved or straight surface, where the air flow travels along said surface. The web run tangenting the curved or straight surface tends to settle in a controlled manner in the vicinity of the curved or straight surface, at a fixed distance as if it were supported by a surface.

The material of both the first and the second sealing element can be for example Teflon®, plastic, rubber, composite or metal, such as steel or aluminium. A requirement for the material is a sufficient rigidity, with which the free flow of air can be prevented. In addition, it should be easily repulpable or entirely non-repulpable in order not to induce problems in pulping, in case small pieces are detached from it.

In an embodiment of the invention, the distance of the first and the second sealing element from the turn roll and/or from the first drying cylinder can be adjusted. Thus, the underpressure in the first underpressure zone can be adjusted so as to be suitable for the running situation. Sometimes it has been observed in practice that the first sealing element creates such an effective sealing that the underpressure in the first underpressure zone rises considerably high. If, for some reason, the suction from the first underpressure zone can not be reduced for decreasing the underpressure, then the location of the first sealing element can be adjusted further away from the turn roll, whereby the gap between the sealing element and the turn roll increases. From this gap air can be allowed to leak to the first underpressure zone from the opening nip of the exit side. It is possible to provide the first sealing element with adjusting means with which the sealing element extension from the lower part of the runnability component can be adjusted so as to be longer or shorter. It is possible to arrange the second sealing element correspondingly adjustable.

In a typical paper machine both the runnability components, the drying cylinders and the turn rolls are elongated in the cross direction of the paper machine or the like. Therefore the pocket space defined by them is also elongated in the cross direction of the machine.

The entry side of the runnability component means that part or surface of the runnability component, preferably the half, which is on the side of the first drying cylinder in the longitudinal direction of the paper machine or the like. Respectively, the exit side of the runnability component means that part or surface of the box-like runnability component, preferably the half, which is on the side of the second drying cylinder in the longitudinal direction of the paper machine or the like. The lower part of the runnability component means, in turn, that part or surface of the runnability component, which is located nearest to the turn roll, and which lower part comprises a lower surface arranged substantially towards the turning suction roll.

It is to be noted that the ends of the pocket spaces are typically sealed, for example by means of end plates according to prior art, such as gap plates. The end plates are provided, in a vertical plane according to machine direction, on both sides on the sides of the machine, and the drying cylinders, the turn roll, the wire and the web run are delimited in the space between them.

According to a preferred embodiment of the invention, the turn roll is a turning suction roll. Thereby, the underpressure can be created in the first underpressure zone by means of an underpressure prevailing inside the turn roll, which underpressure can be made to effect on the first underpressure zone via openings provided on the entire periphery of the roll. According to an embodiment of the invention, the arrangement thereby comprises means for creating underpressure inside the turning suction roll, so that a higher underpressure can be created inside the turning suction roll than in the first underpressure zone and thereby create an air flow from the first underpressure zone to the inside of the turning suction roll. A sucking flow on the periphery of the turning suction roll towards the inside of the roll is active in the direction of the first underpressure zone beginning at the moment when the wire and the web run detach from the surface of the roll (exit point) and ending at the moment when the wire and the web run meet the surface of the roll (entry point).

If the turn roll is a roll, which does not suck air in it, then the underpressure can be created for example by connecting the underpressure zone to an underpressure channel. This kind of an underpressure channel can run for example inside the runnability component from which a connection is then arranged to the first underpressure zone, for example an opening formed in the lower surface of the runnability component. The underpressure can also be arranged by connecting the underpressure zone by means of a connection to another underpressure zone maintained in the pocket space or in its vicinity. In an embodiment of the invention, a turn roll, which has no connection with the means creating the underpressure can thus be used as a turn roll. If a turning suction roll is not used as a turn roll, then the roll can be chosen more freely, whereby for example a grooved roll, a perforated roll, a grooved and perforated roll or a smooth roll can be used. If the roll used is not a suction roll, then considerable cost savings are achieved. A perforated roll jacket with its suction connections forms a considerable cost item, especially as the same structure recurs in the drying section and several corresponding rolls are needed.

In an embodiment of the invention, the turn roll comprises a grooving. The grooving is typically arranged perpendicularly with respect to the axis of the roll, i.e. arranged to travel around the periphery of the roll. The width of the grooves is typically 4-8 mm, preferably 5-7 mm, and their depth is about 2-6 mm, preferably about 3-5 mm. The distance between adjacent grooves is typically 12-25 mm, preferably 15-20 mm. A grooved and perforated suction roll (vac-roll), a grooved and perforated roll, a grooved roll, a perforated roll or a smooth roll can function as a turn roll/a turning suction roll.

According to an embodiment of the invention, the first sealing element's edge facing the turn roll comprises rises, which can be fitted to the grooves of the turn roll. Alternatively, the first sealing element can be made of soft wearing material, whereby the mechanical wear during the use creates rises in the sealing strip, which rises correspond to the grooves of the turn roll. The sealing element can be made, for example, of Teflon® or it can be brush-like comprising a large number of thin bristles grouped densely to each other, which bristles brush the grooves of the turn roll simultaneously preventing air from entering to the first underpressure zone.

If the roll is a turning suction roll, then it is preferably grooved and perforated, and its underpressure sucks air form the pocket space above the turning suction roll, especially from the first underpressure zone. The turning suction roll is preferably a roll according to prior art, whose jacket is provided with apertures and whose jacket surface can also be provided with grooves. The grooves are preferably arranged to travel via the openings, whereby the advantage is achieved that the suction effect spreads in the groove on the area of the periphery, over a long distance and area, thereby intensifying the adhesion between the paper and the roll, and does not remain merely at the area of the opening, which is a relatively limited area being only 2-3 times the area of the diameter of the opening. The grooves and the openings are arranged with respect to the width of the web run so that the grooves and the openings cover substantially the entire web run width.

In this application, a higher underpressure means a lower absolute pressure. Respectively, a lower underpressure means a higher absolute pressure. An underpressure means a pressure, which is lower than the normal atmospheric pressure.

In known solutions, the underpressure inside the turning suction roll has been about 2000-2500 Pa. Due to the arrangement according to the invention, the amount of air needed for creating the underpressure and handled by, for example, a fan, can be considerably reduced, which has an effect on a substantial energy saving, for example, from the level of 800-1000 $m^3$/hour/meter of web width to the level of 400 $m^3$/hour/meter of web width. The underpressure of the turning suction roll sucks air from the pocket space above the turning suction roll, especially from the first underpressure zone. In order to create an underpressure in the turning suction roll, there is no need to consume a large amount of energy, as the elements directing the air flows and the blows are used more precisely and economically than in prior art, and part of the blows can be totally eliminated.

According to an embodiment of the invention a channel (by-pass) is arranged in the runnability component, between the first and the second underpressure zone, along which channel the air can be allowed to transfer between said underpressure zones and with which it is thereby possible to guide the underpressures of the underpressure zones by adjusting the flow, for example to balance the pressure difference in a desired manner. The by-pass channel is thereby a controlled active leak channel between said underpressure zones. According to this embodiment, the arrangement comprises

- a second underpressure zone in a part of the pocket space located above the sealing element, which second underpressure zone is delimited, in addition to the sealing element, by the first drying cylinder and the entry side of the runnability component, and
- means for creating underpressure in the second underpressure zone so that in the second underpressure zone a higher underpressure can be created than in the first underpressure zone.

According to an embodiment of the invention, the channel connecting the underpressure zones to each other is divided into parts in the machine direction, which parts are located adjacent to each other in the cross direction of the machine. The runnability component can be divided in a corresponding manner into parts in the machine direction, whereby the runnability component can be provided with at least one, preferably several partition walls in the machine direction. In this manner the pocket space can be divided into several adjacent underpressure sections, which can be controlled independently. This enables optimization of the underpressure conditions so as to be suitable for each running situation. The first and second underpressure zones of the adjacent underpressure sections can be optimized such that for example a first underpressure prevails in the first underpressure zones, in the outermost sections, which first underpressure is substantially different, either higher or lower than the underpressure in the first underpressure zones of the middlemost underpressure sections located between the outermost underpressure sections. In a corresponding manner, the underpressures in the second underpressure zones of the outermost and the middlemost underpressure sections can differ from each other.

In order to adjust the pressure differences between the first and the second underpressure zones it is possible to use valves or throttles, which can be controlled preferably together with other control means of the paper machine or from the side of the paper machine, from the tending side or the driving side. The adjustment can be based on adjusting of the pressure and/or of the flow.

In case several adjacent underpressure sections are used, it is possible to turn or otherwise adjust separately, independently from each other, the valves, throttles, turn plates or other adjusting means in the channels connecting the first and the second underpressure zones to each other, so that the underpressure in the first underpressure zone separated by the sealing element can be adjusted so as to be different from the second underpressure zone at different locations in the cross machine direction.

According to an embodiment of the invention, the arrangement comprises a divided tail threading zone in the channel between the underpressure zones, the operation of which zone is controlled in a precise manner during and after the tail threading. During the tail threading the air flow and/or pressure in the channel can be controlled into one value and after the tail threading, i.e. in a normal running situation with a wide web run, to a second value. The tail threading zone can be located, with respect to the web run, on the tending side, on the driving side or in the central area of the web run.

An embodiment of the invention comprises one or several tail threading means, which can be for example different kinds of devices needed for forming, transferring, receiving, guiding and further transferring of the tail end. These devices can also be different kinds of water cutters, means for slating draw, dampers and measuring devices. The tail threading means can be located in the edge area of the web run, either on the tending side or on the driving side. They can also be in the central area of the web run, for example in the center line. For the tail threading sector, it is especially preferable to provide the sealing strip for the possibility for different properties, such as for directing blows or suctions. Appropriate surface roughnesses, coatings can also be incorporated also on the jacket of the turning suction roll in the tail threading sector or in the tail threading zone, which can be coupled as an extension of the jacket, possibly also as a separate tail threading zone.

BRIEF DESCRIPTION OF THE FIGURES

The invention is described in more detail below with reference to the enclosed schematic drawing, in which.

DETAILED DESCRIPTION OF THE EXAMPLES OF THE FIGURES

Figure 1:
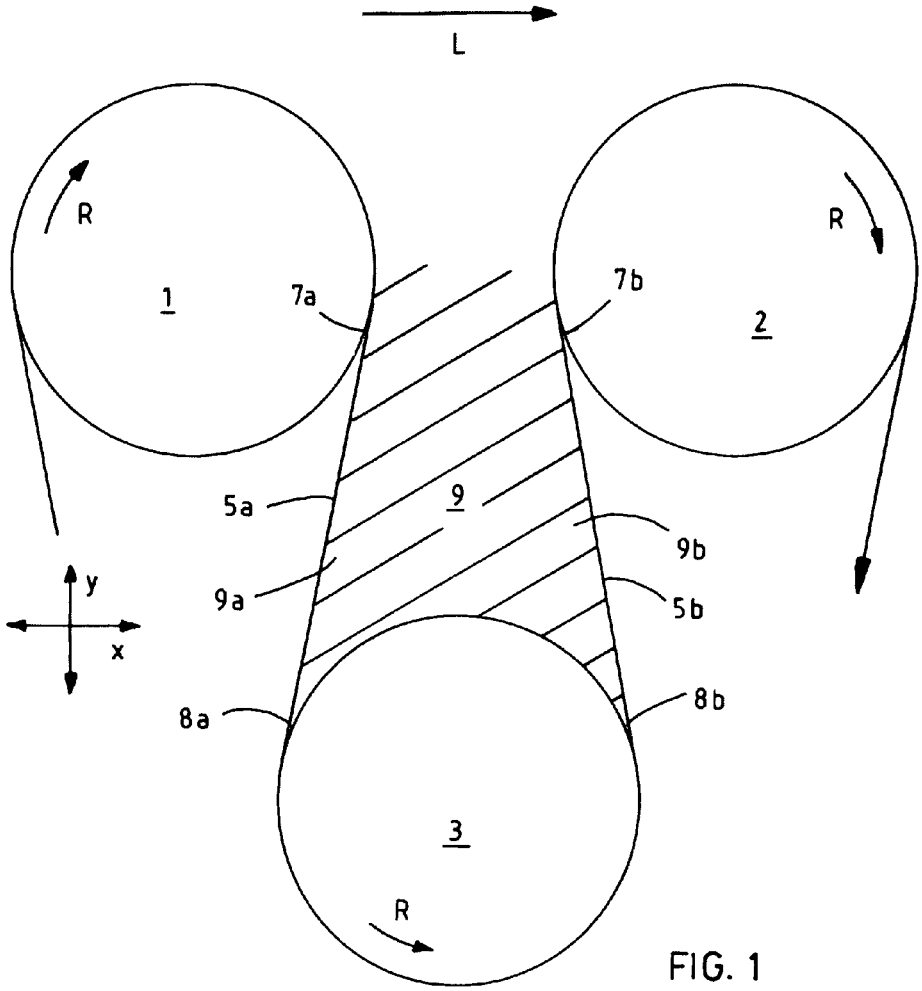
FIG. 1 Prior Art
FIG. 1 is a schematic view of a pocket space between two drying cylinders and one turning suction roll.

FIG. 1 shows as a schematic view a pocket space 9 forming part of the arrangement of the invention and known as such, between two drying cylinders 1, 2 and one turning suction roll 3 in the drying section of a paper machine. The pocket space 9 is delimited by a first drying cylinder 1, a second drying cylinder 2, a turning suction roll 3 and a wire 5*a*, 5*b*. Described more in detail, the pocket space 9 is delimited, on its entry side 9*a*, by a wire draw 5*a* between the first drying cylinder 1 and the turning suction roll 3, and on the exit side 9*b* of the pocket space, by a wire draw 5*b* between the turning suction roll 3 and the second drying cylinder 2. The location of the turning suction roll in a horizontal direction x and in a longitudinal direction L of the paper machine is between the drying cylinders 1, 2, but in a vertical direction y lower than said cylinders 1, 2. The directions of rotation of the cylinders 1, 2 and of the roll 3 are shown by arrows R. It is to be understood, that the above-presented structure is recurred by its substantial parts being repeated in the drying section of a paper or a board machine. Minor structure-specific exceptions and tailoring can be created by, for example, the tail threading means, which can be, for example, different kinds of means needed for forming, transferring, receiving, guiding and further transferring of the tail end. These means can also be different kinds of water cutters, means for slating draw, dampers and measuring devices.

In this figure and in the others, the web run travels between the drying cylinders and the wire and, respectively, outside the wire on the turning suction roll.

FIG. 1 also shows

- an opening nip 7*a* of the first drying cylinder 1, i.e. the point where the wire 5*a* detaches from the periphery of the first drying cylinder 1 towards the turning suction roll 3,
- a closing nip 8*a* of the turning suction roll, i.e. the point where the wire 5*a* enters into connection with the turning suction roll 3 after the first drying cylinder 1,
- an opening nip 8*b* of the turning suction roll 3, i.e. the point where the wire 5*b* detaches from the periphery of the turning suction roll 3 towards the second drying cylinder 2,
- a closing nip 7*b* of the second drying cylinder 2, i.e. the point where the wire 5*b* enters into connection with the second drying cylinder 2 after the turning suction roll 3.

Figure 2:
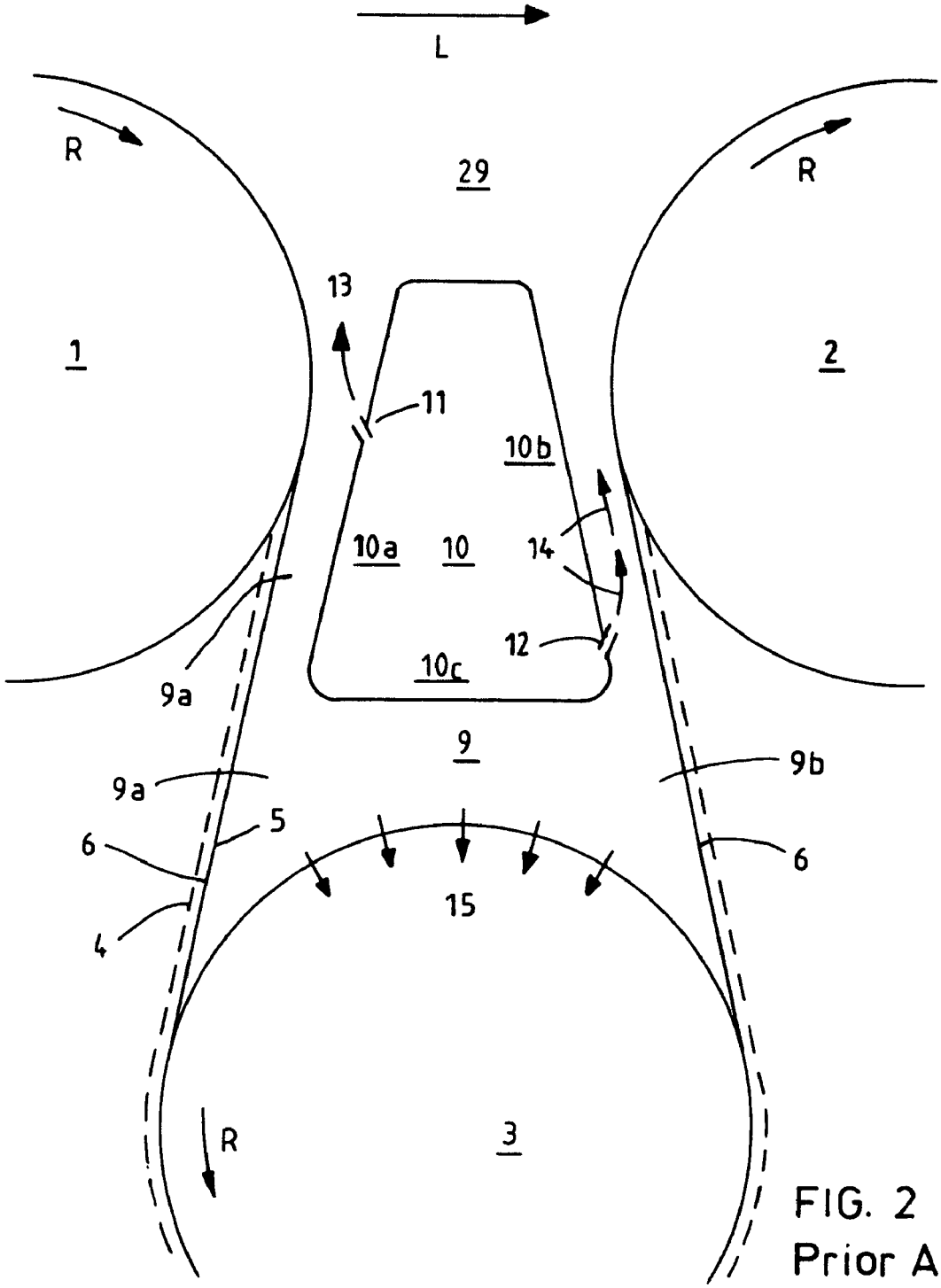
FIG. 2 Prior Art
FIG. 2 shows an arrangement according to prior art in connection with drying cylinders and turning suction roll of a paper machine.

FIG. 2 shows an arrangement according to prior art in connection with the pocket space 9 between the drying cylinders 1, 2 and the turning suction roll 3 of a paper machine, which arrangement is provided with a runnability component 10, which in this example is a blow box. The blow box is provided with two blow nozzles 11, 12 in order to create an underpressure zone in the pocket space 9. In connection with the entry side 10*a* of the runnability component 10 there is an entry side blow nozzle 11, which on the entry side 9*a* of the pocket space 9 blows air in connection with the gap between the runnability component 10 and the first drying cylinder 1 against the travelling direction of the web run 6 away from the pocket space 9 according to arrow 13, and thereby ejects air away from the pocket space 9 and prevents the air entailed by the web run 6 from entering into the pocket space 9 via the gap between the first drying cylinder 1 and the entry side 10*a* of the runnability component. The blow nozzle 11 can utilize the Coanda-effect. In addition, the underpressure of the pocket space 9 is controlled by an exit side blow nozzle 12, which blows air on the exit side 9*b* of the pocket space 9 in the travelling direction of the web run 6 according to arrow 14, and thereby ejects air away from the pocket space 9 and prevents the air from entering into the pocket space via the gap between the exit side 10*b* of the runnability component and the second drying cylinder 2. In addition to the blow box 10, the underpressure of the pocket space 9 is created by means of the turning suction roll 3. The suction of the turning suction roll 3 is presented by arrows 15, of which suction only a part is presented.

Figure 3:
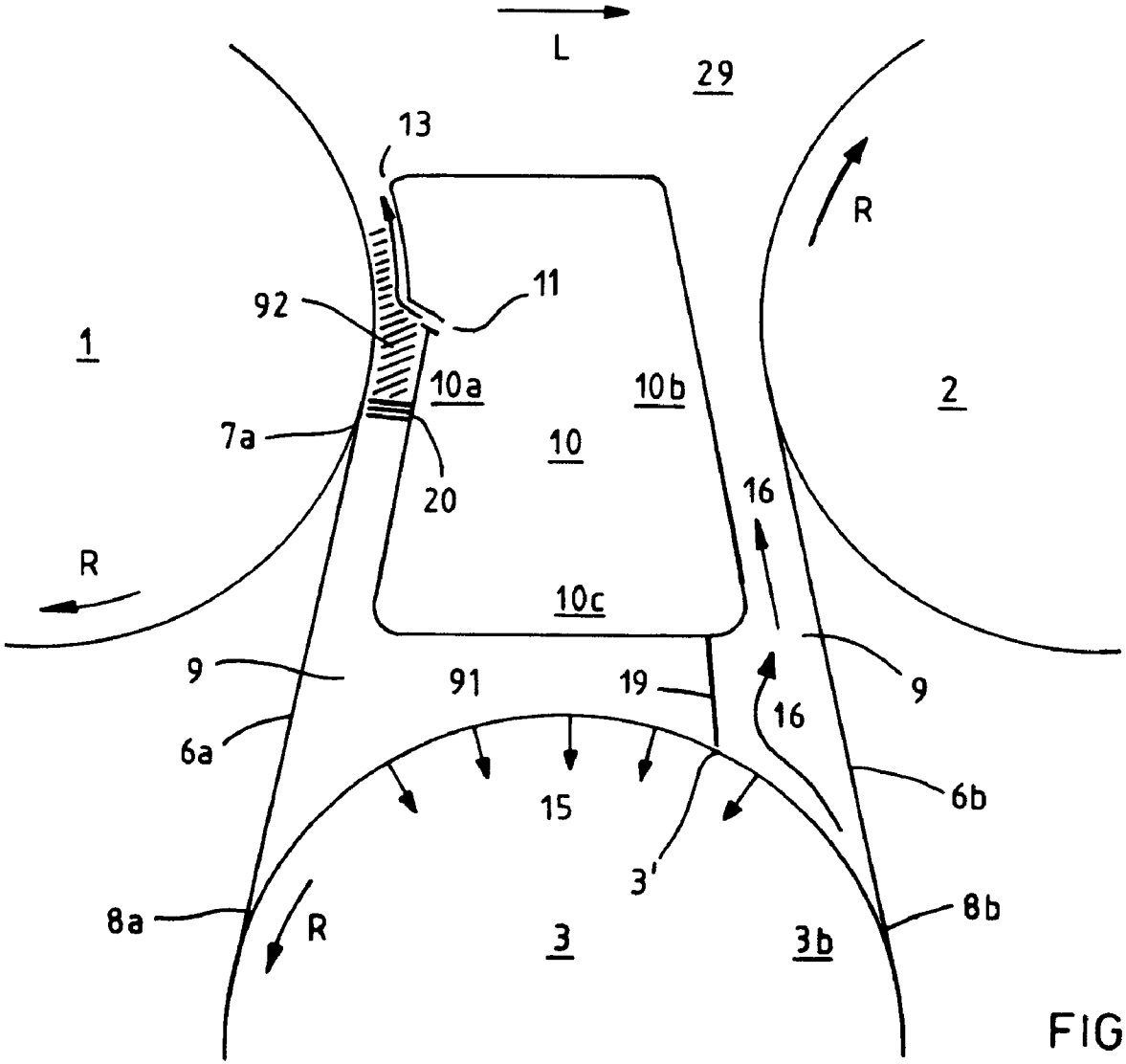
FIG. 3 shows an arrangement according to the first embodiment of the invention in connection with two drying cylinders and one turning suction roll.

FIG. 3 shows an arrangement according to the first embodiment of the invention in connection with two drying cylinders 1, 2 and one turning suction roll 3 of a paper machine. A sealing strip 19 is arranged on the exit side of the lower part 10*c* of the blow box. On the entry side 10*a* of the blow box, a labyrinth sealing 20 is arranged in connection with the opening nip 7*a* between the blow box and the first drying cylinder 1 preceding the turning suction roll 3. A first underpressure zone 91 is created in the pocket space, which first underpressure zone is delimited by a labyrinth sealing 20, the web draw 6*a* between the entry side drying cylinder 1 and the turning suction roll 3, the upper surface of the turning suction roll, the sealing strip 19 and by the lower part 10*c* and the entry side 10*a* of the blow box, as well as by the gap plates in the ends of the pocket space. The purpose of the sealing strip 19 is to guide the air flow 16 moving in connection with the exit side 3*b* surface of the turning suction roll 3, in the direction of rotation R of the roll 3, away from the connection with the surface of the turning suction roll 3. The aim is to guide the air flow 16 so that it would not enter the first underpressure zone 91 but would be guided after the opening nip 8*b* of the turning suction roll 3 away from the pocket space 9 in the direction of the web run 6*b* (the direction is presented by an arrow 16).

The second underpressure zone 92, in which the underpressure is usually higher than in the first 91, is formed in the part of the pocket space located above the labyrinth sealing 20 due to an air jet 13 from the blow nozzle 11 on the entry side 10*a* of the blow box. The air jet 13 of the blow nozzle 11 is directed to the entry side of the runnability component, where it is directed outwards preferably by a narrow slit or a row of openings. The flow follows a shaped extension and rises upwards in the direction of a curved surface against the incoming direction of the web run. The second underpressure zone 92 is delimited in its lower part by the labyrinth sealing 20 and in the sideward direction by the first drying cylinder 1 and the entry side 10*a* of the blow box and by the gap plates in the ends of the pocket space. The space outside the pocket space is marked with reference number 29.

Figure 4:
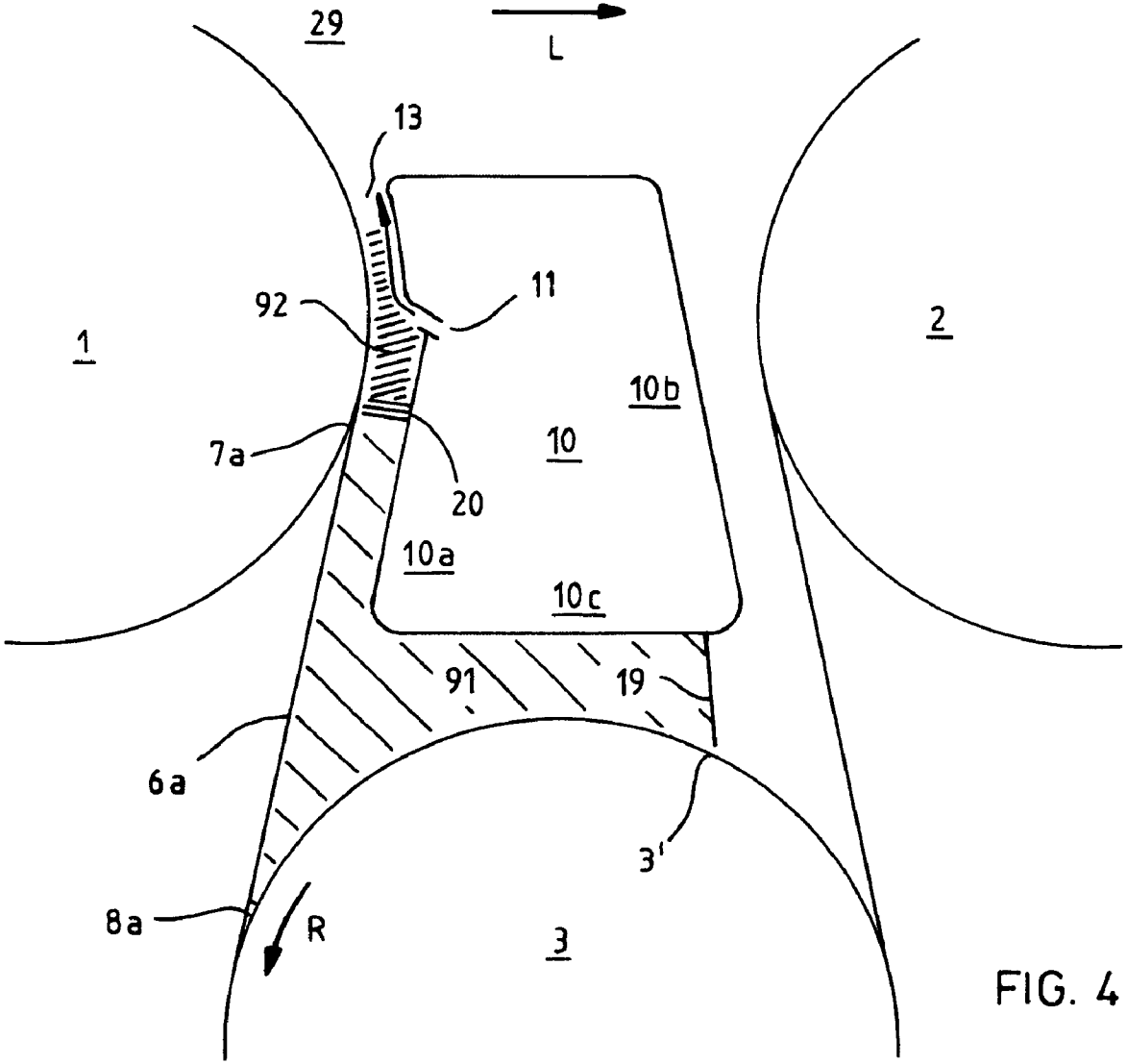
FIG. 4 shows the first underpressure zone and the second underpressure zone of the arrangement of FIG. 3.

In FIG. 4, the first underpressure zone 91 of the arrangement of FIG. 3 is marked with coarse slanting stripes and the second underpressure zone 92 with dense slanting stripes.

Figure 5:
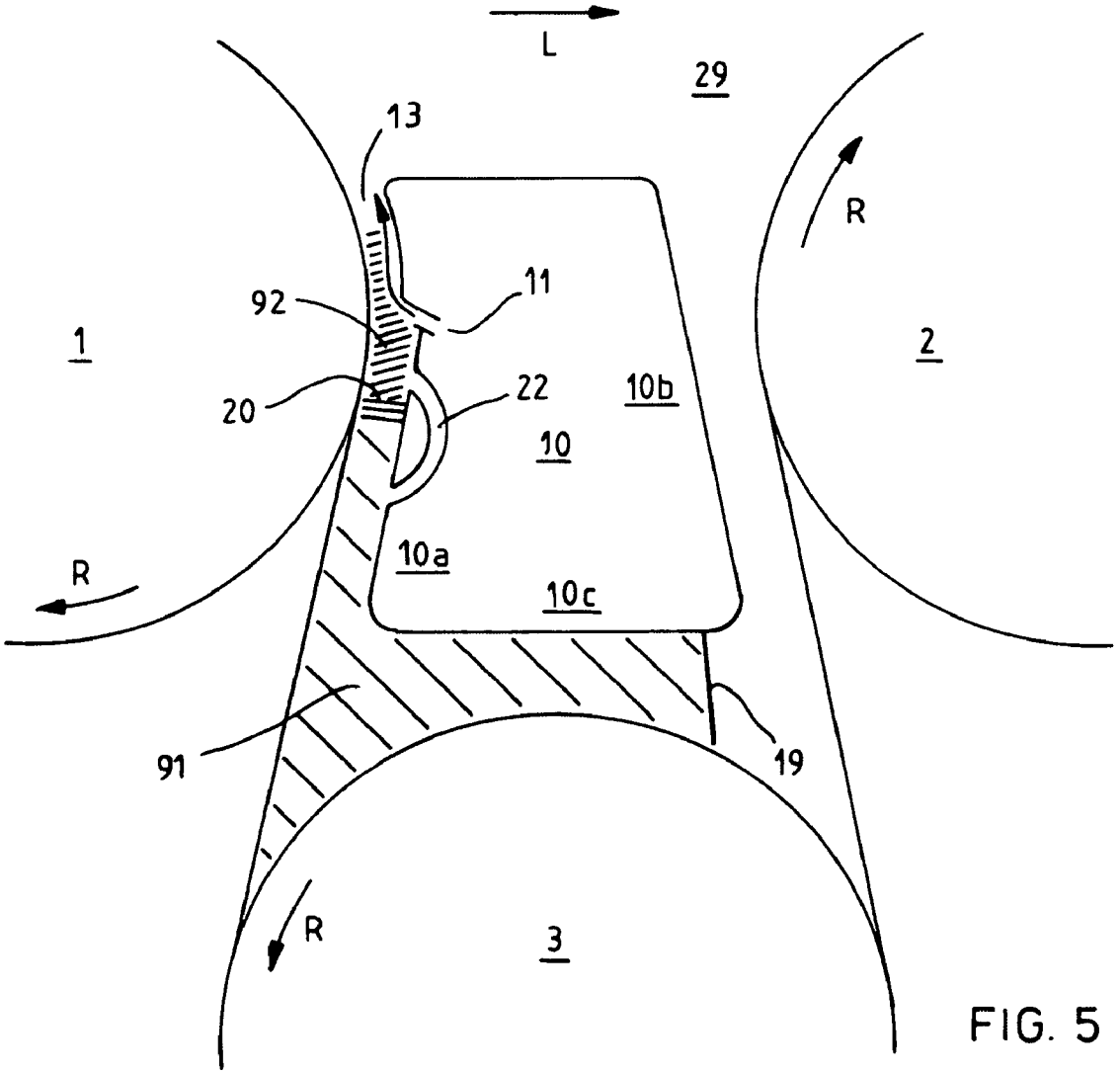
FIG. 5 shows an arrangement according to the second embodiment of the invention.

FIG. 5 shows an arrangement according to an other embodiment of the invention in connection with two drying cylinders 1, 2 and one turning suction roll 3 of a paper machine. On the entry side 10*a* of the blow box, a labyrinth sealing 20 is arranged in connection with the opening nip 7*a* between the blow box and the first drying cylinder 1 located before the turning suction roll 3. A first underpressure zone 91 is created in the pocket space, which first underpressure zone is delimited by the labyrinth sealing 20, the web draw 6*a* between the entry side drying cylinder 1 and the turning suction roll 3, the upper surface of the turning suction roll, and by the lower part 10*c* and the entry side 10*a* of the blow box and by the sealing strip 19. A second underpressure zone 92, in which the underpressure is usually higher than in the first underpressure zone 91, is formed in the part of the pocket space located above the labyrinth sealing 20 due to an air jet 13 from the blow nozzle 11 on the entry side 10*a* of the blow box. The second underpressure zone 92 is delimited in its lower part by the labyrinth sealing 20 and in the sideward direction by the first drying cylinder 1 and the entry side 10*a* of the blow box and by the gap plates in the ends of the pocket space. The space outside the pocket space is marked with reference number 29. The labyrinth sealing can be realized also as a multi-stepped sealing.

The first underpressure zone 91 of the arrangement of FIG. 5 is marked with coarse slanting stripes and the second underpressure zone 92 with dense slanting stripes. The runnability component 10, which in this example is a blow box, is provided with a by-pass channel 22 arranged between the first underpressure zone 91 and the second underpressure zone 92, by means of which by-pass channel 22 the underpressures of or the pressure difference between the underpressure zones 91, 92 can be regulated, for example balanced, in a controlled and desired manner.

Figure 6A:
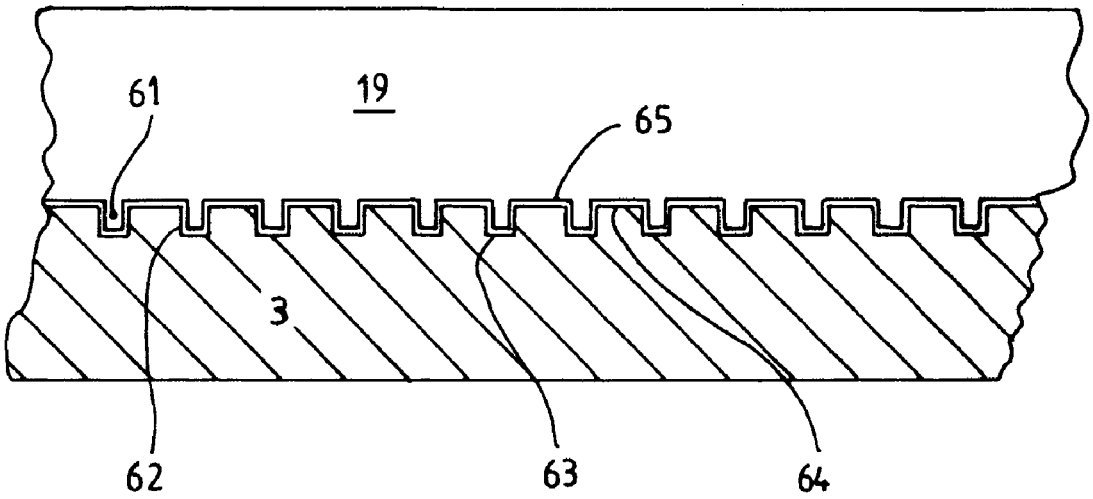
FIG. 6*a* shows an example of a grooving formed in the surface of the turn roll as a cross section of the roll surface and the corresponding rises in the sealing strip.
Figure 6B:
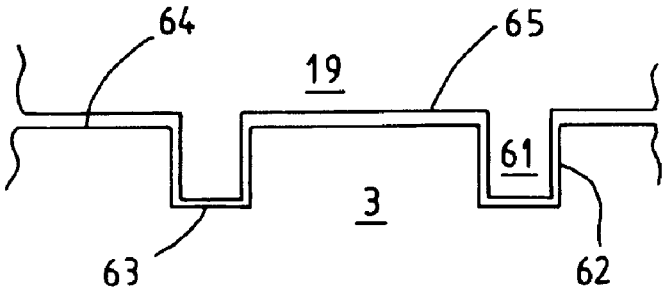
FIG. 6*b* shows an example of the interface of the sealing strip and the turn roll.

FIG. 6*a* shows, as a front view of the sealing strip, the rises 61 formed in the edge 65, which rises can be located at even distances from each other. The rises 61 extend to the corresponding grooves 62 on the surface of the turning suction roll 3. The rises 61 in the sealing strip 19 can be fitted in the grooves 62 in the turning suction roll also so that the air film travelling on the surface of the roll 3 can be cut or scraped also at the location of the grooves 62. By means of these rises 62, the travel of the air film can be cut or prevented on the surface of the turning suction roll 3 also via the grooves 62, whereby the operation of the sealing strip 19 is more efficient than without rises. The rises 61 can extend substantially close to the bottom 63 of the grooves 62 provided in the turning suction roll. In a grooved turning suction roll 3, the typical width of a groove 62 is 5-7 mm, and the distance between the grooves, i.e. the width of the neck 64, is typically 15-20 mm. The depth of the groove 62, i.e. the distance between the surface of the neck 64 and the bottom of the groove 63, is typically about 3-5 mm. The sealing strip is provided with respective dimensions equipped with a clearance of about 0.5-1.0 mm in width and height in order to prevent a direct contact. The form of the rise 61 of the sealing strip shown in the figure is a square or a rectangle, but it can also be rounded from its top, whereby the respective groove can also be rounded. Different kinds of profile tools can thus be used for manufacturing the rise and the groove. FIG. 6*b* shows, as an enlarged view, a situation as the one in FIG. 6*a*.

Figure 6C:
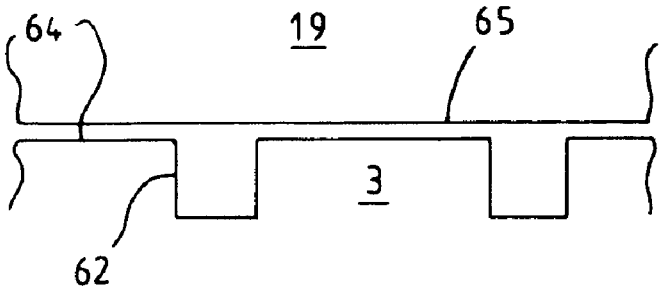
FIG. 6*c* shows an example of the interface of the sealing strip and the turn roll.

FIG. 6*c* shows an embodiment of the invention, in which a sealing strip 19 having a straight edge 65 is brought close to the grooved turning suction roll 3. Thus, the edge 65 is not provided with rises, which would enter into the grooves 62 of the roll. The distance between the edge 65 of the sealing strip and the point of the roll located closest to the sealing strip, i.e. the surface 64 of the neck, is kept for example between 0.5-1.0 mm.

The sealing strip can be fitted to be turned for example around the point, where the sealing strip is fixed to the runnability component 10. Thereby the cleaning of the sealing strip and the grooves is easier. The turning can be realized for example mechanically, pneumatically or hydraulically. The sealing strip 19 can be assembled of, for example, adjacent elements, whereby transportation of the strips is easier, and no bracings are needed for the long and thin strips. In addition, then the rises 61 corresponding to the grooves 62 are easier to manufacture and the defects in, for example, line spacing due to positioning cannot be so easily repeated in long pieces.

The invention is not meant to be limited to the embodiments shown as examples above but, on the contrary, the aim is to interpret it extensively within the scope of protection defined in the claims below.

What is claimed is:

1. A runnability component for a drying section of a paper machine, the machine having a pocket space between two drying cylinders and one turn roll, the pocket space being formed by a first drying cylinder, a second drying cylinder located after the first drying cylinder in the longitudinal direction of the machine, a turn roll located between, and offset from, the first and second drying cylinders, and a wire supporting a web and travelling from the first drying cylinder to the turn roll and from the turn roll to the second drying cylinder, a first web run being formed between the first drying cylinder and the turn roll and a second web run being formed between the turn roll and the second drying cylinder, with the web running on an outer surface of the wire relative to the pocket space and on the periphery of the turn roll, the runnability component comprising:

a box-shaped component elongated in the cross-direction of the paper machine and extending substantially over an entire width of the first and second web runs and positionable in the pocket space, the box-shaped component having an entry side, an exit side, and an intermediate side between the entry side and the exit side, the entry side having an entry side blow nozzle positioned to blow air substantially against a travel direction of the web and away from the pocket space in a gap between the box-shaped component and the first drying cylinder;

a first sealing element on an outer surface of the intermediate side of the box-shaped component positioned to seal a gap between the box-shaped component and the turn roll, the first sealing element being provided with means for adjusting a distance between the first sealing element and the turn roll; and a second sealing element on an outer surface of the entry side of the box-shaped component positioned to seal a gap between the box-shaped component and the first drying cylinder.

2. The runnability component of claim 1, wherein the first sealing element is positioned adjacent the exit side of the box-shaped component.

3. The runnability component of claim 2, wherein at least one of the first and the second sealing elements is a labyrinth sealing member having more than one chamber.

4. The runnability component of claim 1, wherein the first sealing element is positioned in a streamlined air flow manner with respect to a plane defined by the exit side of the box-shaped component.

5. The runnability component of claim 1, wherein one or both of the first and the second sealing elements is a sealing strip.

6. The runnability component of claim 1, wherein at least one of the first and the second sealing elements is a labyrinth sealing member having at least one chamber.

7. The runnability component of claim 1, wherein at least one of the first and second sealing elements is elongated in the cross direction of the paper machine and sized to extend substantially over an entire width of the first and second web runs.

8. The runnability component of claim 1, wherein at least one of the first and second sealing elements is divided into parts in the cross direction of the machine.

9. The runnability component of claim 1, wherein the second sealing element is provided with means for adjusting a distance between the second sealing element and the first drying cylinder.

10. The runnability component of claim 1, wherein an edge of the first sealing element facing the turn roll comprises rises.

11. The runnability component of claim 10, wherein the rises of the first sealing element are sized to be fitted into grooves of the turn roll.

12. A drying section of paper machine comprising the runnability component of claim 1 positioned in the pocket space formed by a first drying cylinder, a second drying cylinder located after the first drying cylinder in the longitudinal direction of the machine, a turn roll located between, and offset from, the first and second drying cylinders, and a wire supporting a web and travelling from the first drying cylinder to the turn roll and from the turn roll to the second drying cylinder.

13. The drying section of claim 12, wherein the turn roll is a suction roll.

14. The drying section of claim 13, further comprising means for creating an underpressure inside the turn suction roll so that a higher underpressure can be created inside the turn suction roll than in a first underpressure zone, the first underpressure zone being defined by the first sealing element, the intermediate side of the box-shaped component, the entry side of the box-shaped component, the second sealing element, the wire, and the turn roll, a difference in underpressure between the turn suction roll and the first underpressure zone being sufficient to thereby provide an air flow from the first underpressure zone into the turn suction roll.

15. The drying section of claim 12, wherein the turn roll comprises a grooving.

16. A method for saving energy in a drying section of a paper machine, the machine having a pocket space between two drying cylinders and one turn roll, the pocket space being formed by a first drying cylinder, a second drying cylinder located after the first drying cylinder in the longitudinal direction of the machine, a turn roll located between, and offset from, the first and second drying cylinders, and a wire supporting a web and travelling from the first drying cylinder to the turn roll and from the turn roll to the second drying cylinder, a first web run being formed between the first drying cylinder and the turn roll and a second web run being formed between the turn roll and the second drying cylinder, with the web running on an outer surface of the wire relative to the pocket space and on the periphery of the turn roll, the method comprising:

sealing off the pocket space with a box-shaped component elongated in the cross-direction of the paper machine and extending substantially over the entire width of the first and second web runs and positioned in the pocket space, the box-shaped component having an entry side, an exit side, and an intermediate side between the entry side and the exit side, the entry side having an entry side blow nozzle positioned to blow air substantially against the travel direction of the web and away from the pocket space in a gap between the box-shaped component and the first drying cylinder; and sealing off a gap between the box-shaped component and the turn roll with a sealing element on an outer surface of the intermediate side of the box-shaped component, the first sealing element being provided with means for adjusting a distance between the first sealing element and the turn roll.

17. The method of claim 16, wherein the sealing element is positioned adjacent the exit side of the box-shaped component.

18. The method of claim 16, wherein an edge of the sealing element facing the turn roll comprises rises to be fitted into grooves of the turn roll.

19. The method of claim 16, further comprising sucking air from the pocket space into the turn roll.

* * * * *